United States Patent [19]

Batchelor

[11] Patent Number: 4,862,550

[45] Date of Patent: Sep. 5, 1989

[54] ROLLER MOP SPONGE RETAINER

[75] Inventor: Douglas R. Batchelor, Chicago, Ill.

[73] Assignee: Libman Broom Company, Arcola, Ill.

[21] Appl. No.: 283,136

[22] Filed: Dec. 12, 1988

[51] Int. Cl.[4] ..... A47L 13/144

[52] U.S. Cl. ..... 15/119 A

[58] Field of Search ..... 15/116.1, 145, 244.1, 15/119 R

[56] References Cited

U.S. PATENT DOCUMENTS

| | | | |
|---|---|---|---|
| 3,727,259 | 4/1973 | Wilson | 15/119 A |
| 4,481,688 | 11/1984 | Graham | 15/119 A |
| 4,516,287 | 5/1985 | Johnson et al. | 15/119 A |
| 4,706,323 | 11/1987 | Batchelor | 15/119 A |

*Primary Examiner*—Chris K. Moore

*Attorney, Agent, or Firm*—Marshall, O'Toole, Gerstein, Murray & Bicknell

[57] ABSTRACT

A roller sponge mop sponge retainer having a channel shaped sponge retainer adapted to hold a roll mop sponge; the retainer having an elongated top and side walls extending downwardly from the top; the top being uniformly wide with a longitudinal center line; the top having a central section hook catch terminating in first end edges lateral to the top; the top between each first end edge of the central section and an adjacent second edge having a lateral depressed concave portion vertically lower than the adjacent central section first end edge and defining a vertical opening into which a free end of an operating rod hook can be inserted; and a groove in the top extending longitudinally outwardly from a second edge for receiving and guiding an operating rod hook free end beneath the central section and above the two depressed concave portions.

11 Claims, 2 Drawing Sheets

ROLLER MOP SPONGE RETAINER

This invention relates to sponge mops. More particularly, this invention is concerned with an improved sponge retainer for a roller sponge mop.

BACKGROUND OF THE INVENTION

Sponge mops of various types and designs have been commercially available for many years. They are widely used in the home because of their light weight and efficiency in cleaning kitchen and bathroom floors and other surfaces.

One specific type of sponge mop is referred to as a roller sponge mop. Such a mop has a sponge mounted in a retainer. The mop includes a rod which has a hook at one end which engages the retainer. When the rod is displaced in one direction the sponge is moved between opposing rollers which apply pressure and squeeze water out of the sponge. Movement of the rod in the opposite direction moves the sponge outwardly from between the rollers into cleaning position. One such roller sponge mop is disclosed in Johnson et al U.S. Pat. No. 4,516,287.

Because the sponge has a limited useful life it must be replaced periodically. Accordingly, roller sponge mops are provided with a replaceable cleaning assembly consisting of a sponge mounted in an elongated channel member or retainer. One such replaceable cleaning assembly is disclosed in Wilson U.S. Pat. No. 3,727,259. However, the assembly disclosed in the Wilson patent requires a separate latch plate to secure the rod hook in place in the retainer. This complicates removing a worn assembly from the mop and installing a new assembly.

Batchelor U.S. Pat. No. 4,706,323 also discloses a sponge mounted in a retainer for a roller mop. While that retainer is commercially useful, and even though it is structurally relatively simple, it is still more involved than is desired. Additionally, the rod hook would sometimes disengage from the retainer during use.

A need thus exists for a simpler structure which will facilitate installation and removal of a replaceable cleaning assembly used on a roller sponge mop.

SUMMARY OF THE INVENTION

The invention provides a roller sponge mop sponge retainer comprising an elongated channel shaped sponge retainer adapted to receive and securely hold a roll mop sponge; the retainer having an elongated top and two equally spaced apart side walls extending downwardly from the top; the elongated top having a substantially uniform width and a longitudinal center line; the elongated top having a central section hook catch terminating in first end edges lateral to the top; the elongated top between each first end edge of the central section and an adjacent second edge having a lateral depressed concave portion vertically lower than the adjacent central section first end edge; each adjacent central section first end edge and depressed concave portion defining a vertical opening into which a free end of an operating rod hook can be operatively inserted; and a groove in the elongated top extending longitudinally outwardly from one or both second edges for slidably receiving and guiding an operating rod hook free end into a vertical opening to position it beneath the central section and above the two depressed concave portions.

The sponge retainer is adapted for use in a sponge mop equipped with a hook having a loop located between the hook free end and a rod portion perpendicular to the hook free end so that when the hook free end is beneath the central section the hook loop abuts a retainer top second edge and prevents withdrawal of the hook free end from the retainer.

The retainer can be a sheet metal stamping.

The groove can be between the top longitudinal center line and a side wall. A single groove can be located on one longitudinal side of the central portion, or one groove can be on each side of the longitudinal central portion. When two grooves are used they can be on the same or opposite sides of the longitudinal center line.

The groove can have a laterally curved bottom. Also, the groove can be widest and deepest at the second edge and become narrower and shallower with increase in length until it terminates by merging smoothly into the retainer top.

The groove can be slightly slanted towards the longitudinal center line as it approaches the central portion.

Each end edge of the central section can have a raised area on each side of the longitudinal center line of the retainer to facilitate inserting the free end of the hook, at an angle to the said center line beneath the central section, until the hook free end is above the depressed concave portion on the other side of the central section and the hook can then be pivoted into alignment with the longitudinal center line of the retainer thereby preventing the hook from being displaced longitudinally from beneath the central section.

The central section can have a longitudinal ridge beneath which the hook can nest.

DETAILED DESCRIPTION OF THE DRAWINGS

To the extent it is reasonable and practical the same or similar elements which appear in the various views of the drawings will be identified by the same numbers.

Figure 1:
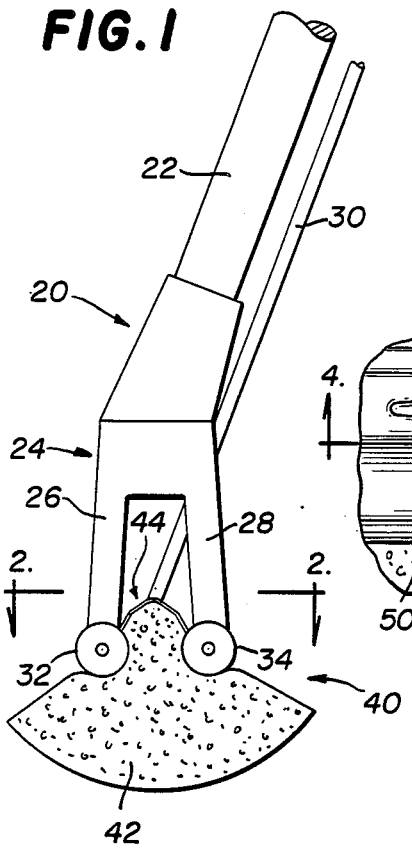
FIG. 1 is a side elevational view of the lower portion of a roller sponge mop having a replaceable cleaning assembly using a sponge retainer according to the invention.

As shown in FIG. 1 the roller sponge mop 20 has a handle 22 with a head 24 at the lower end. The head 24 has spaced apart walls 26,28 which define a slot into which the cleaning assembly 40 can be partially retracted by operating rod 30. A pair of spaced apart rollers 32,34 are mounted on the ends of walls 26,28.

The cleaning assembly 40 consists of a resilient sponge 42 secured in the elongated channel shaped sponge retainer 44, which can be made of sheet metal formed by dies in a stamping operation.

Sponge retainer 44 has a top 46 and two spaced apart mirror image side walls 48,50 extending downwardly from the top. The walls 48,50 have recesses 52 (FIGS. 5 and 6) in which the rollers 32,34 rest (FIG. 1) when the cleaning assembly is in extended position ready for use in cleaning a floor.

Figure 3:
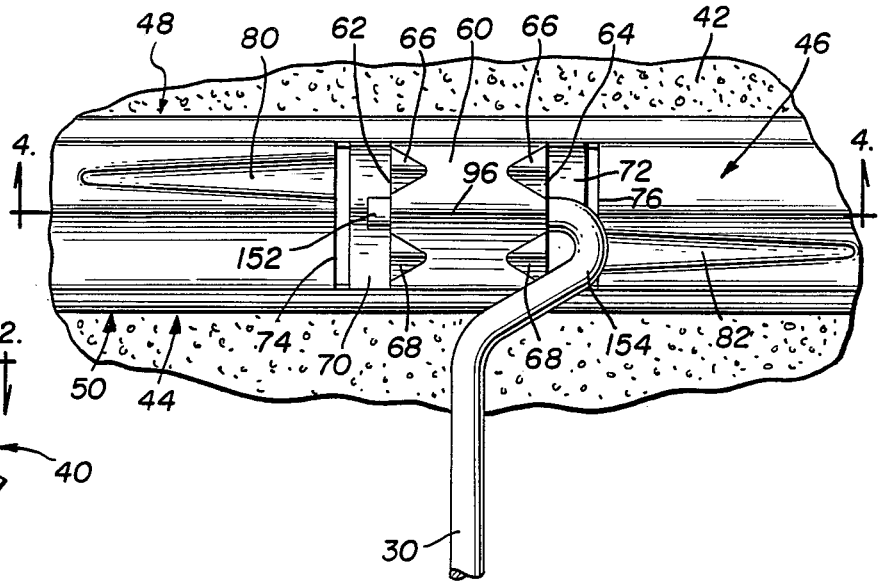
FIG. 3 is an enlarged view of the central part of the cleaning assembly shown in FIG. 2.
Figure 2:
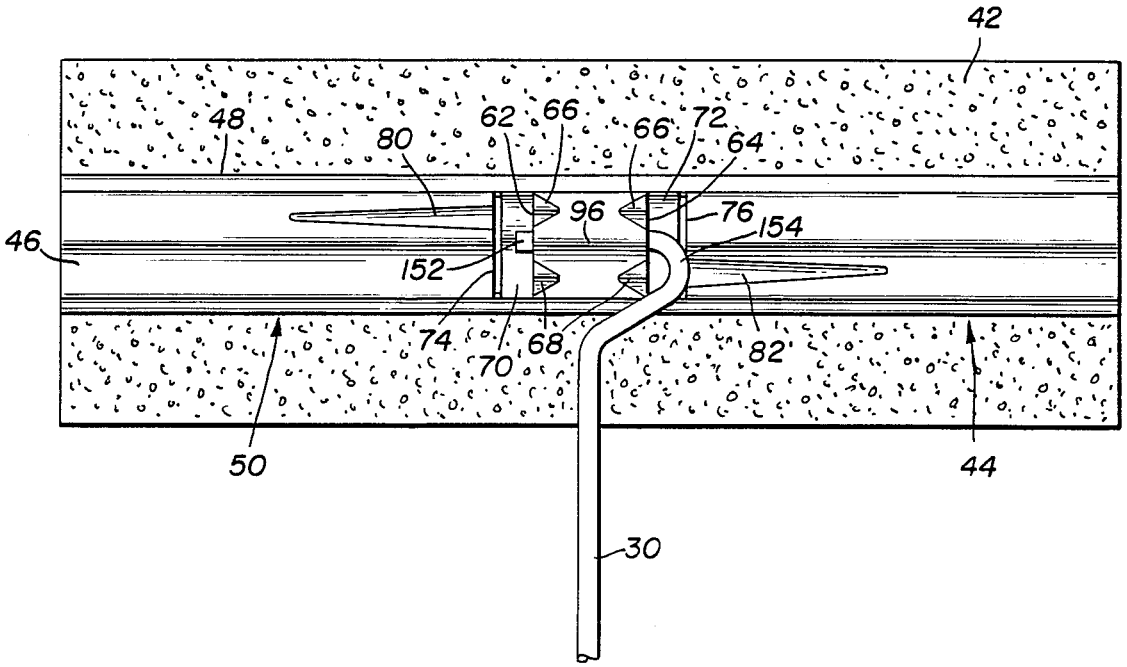
FIG. 2 is a plan view of the cleaning assembly taken along the line 2—2 of FIG. 1.
Figure 4:
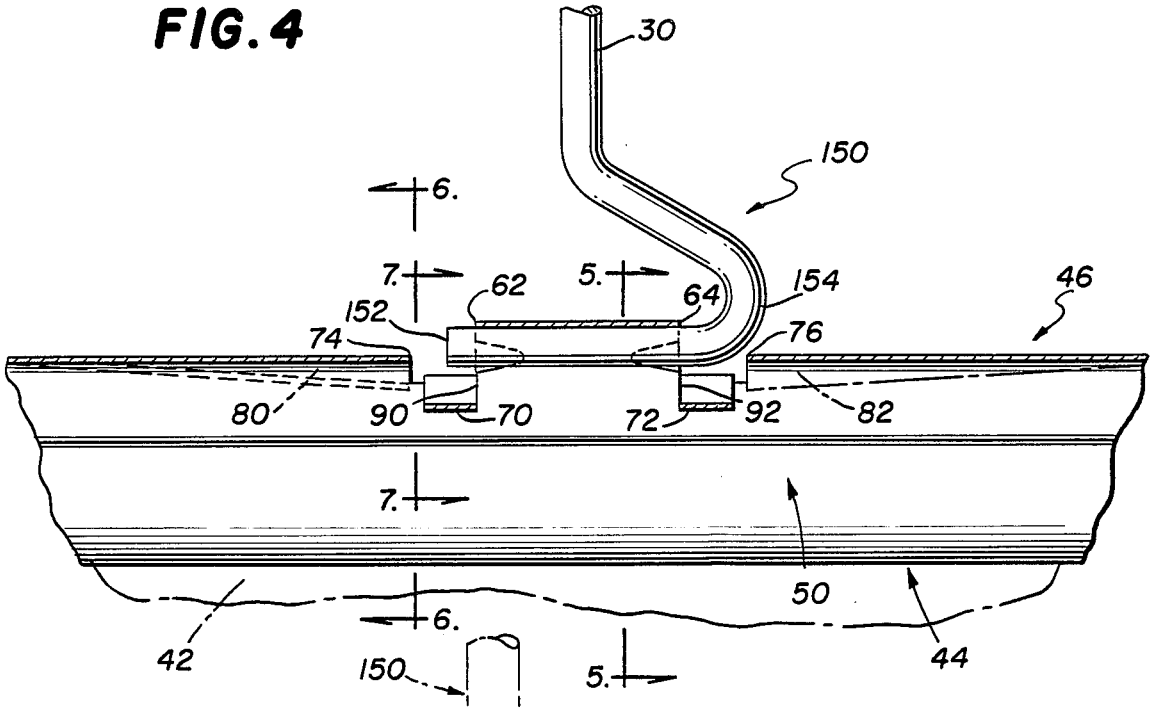
FIG. 4 is a sectional view taken along the line 4—4 of FIG. 3 with the line 4—4 also constituting the longitudinal center line of the retainer top.

The retainer top 46 has a central section hook catch 60 which terminates in first end edges 62,64 lateral to the top 46. Each end edge 62,64 has a pair of raised areas 66,68 (FIGS. 2 and 3), with one raised area on each side of the retainer longitudinal center line 4—4 (FIG. 3). These raised areas provide reinforcement and optional clearance for the free end 152 of hook 150, on the end of rod 30 to be inserted beneath and withdrawn from, the central section 60. The hook 150 also includes a loop portion 154 between the free end 152 and rod 30 (FIG. 4).

Between each first end edge 62,64 of the central section 60 and an adjacent retainer top lateral second edge 74,76 is a respective depressed concave portion 70,72, which are identical. The respective adjacent pairs of end edges and concave portions 62,70 and 64,72 define vertical openings 90,92 into which the free end 152 of hook 150 can be inserted (FIGS. 3 to 5 and 7).

A groove 80,82 is located in the elongated top 46 extending longitudinally outwardly from each respective second edge 74,76 for slidably receiving and guiding the hook free end 152 into a respective vertical opening 90,92 to position it beneath central section 60 and above the two depressed concave portions 70,72. When the hook free end 152 is beneath the central section 60, the hook loop 154 abuts a respective retainer top second edge 74 or 76 and prevents withdrawal of the hook free end from the retainer unless the hook free end is first pivoted towards the groove adjacent the hook loop.

Figure 5:
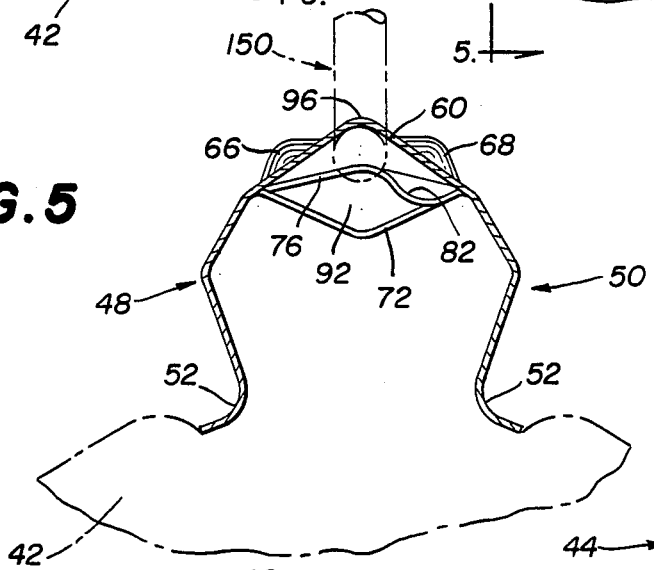
FIG. 5 is a sectional view taken along the line 5—5 of FIG. 4.
Figure 6:
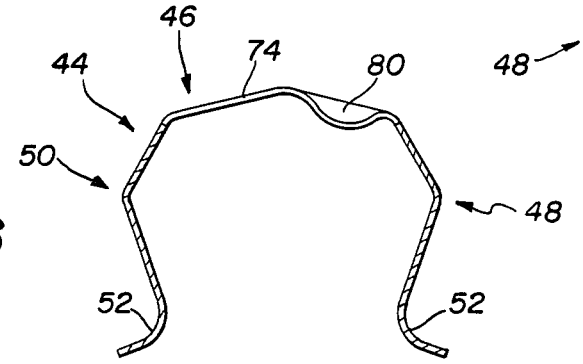
FIG. 6 is a sectional view taken along the line 6—6 of FIG. 4.
Figure 7:
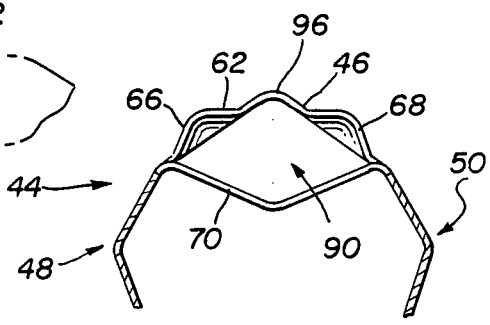
FIG. 7 is a sectional view taken along the line 7—7 of FIG. 4.

Although the grooves 80,82 can be made of uniform width and depth it is desirable for the groove to be widest and deepest at the respective second edge 74 or 76 and to become narrower and shallower with increase in length until it terminates by merging smoothly into the retainer top. Also, the groove desirably has a laterally curved bottom (FIGS. 5 and 6).

Each groove can be positioned between the top longitudinal center line and a side wall. Furthermore, the two grooves 80,82 can be on opposite sides, or on the same side, of the longitudinal center line 4—4 as shown in FIG. 3.

It is also feasible to provide only a single groove 80 or 82 but to facilitate installation on a mop head two grooves are preferred so as to have the retainer correctly orientated regardless of which end is right or left.

The retainer central portion 60 can also have a longitudinal ridge 96 beneath which the hook free end 152 can nest.

The depressed concave portions 70,72 provide support means for the free end 152 of hook 150 when rod 30 moves forward and pushes the cleaning assembly into cleaning position as shown in FIG. 1.

When a cleaning assembly 40 is to be mounted on the mop head 24 the rod 30 is advanced until the hook 150 extends past rollers 32,34. Then the free end 152 of hook 150 is placed in a groove 80,82 and slid along the groove and then under central portion 60 as far as it will go. Then the free end 152 is pivoted counterclockwise until it is in line with centerline 4—4 (FIG. 3). When so aligned the hook nests in ridge 96 in the top of the central section 60. Ridge 96 is positioned along the longitudinal center line of the retainer. When the hook 150 is so positioned, the hook loop 154 contacts a respective second edge 74 or 76 and prevents it from moving axially from beneath the central portion 60.

Once the cleaning assembly is mounted on the hook 150, rod 30 is retracted until the cleaning assembly is brought into position as shown in FIG. 1 with the retainer seated between rollers 32,34. To squeeze the sponge the rod 30 is retracted further to bring the sponge between the rollers following which the rod 30 is advanced to return the sponge to the cleaning position (FIG. 1).

The foregoing detailed description has been given for clearness of understanding only, and no unnecessary limitations should be understood therefrom, as modifications will be obvious to those skilled in the art.

What is claimed is:

1. A roller sponge mop sponge retainer comprising:

an elongated channel shaped sponge retainer adapted to receive and securely hold a roll mop sponge;

the retainer having an elongated top and two equally spaced apart side walls extending downwardly from the top;

the elongated top having a substantially uniform width and a longitudinal center line;

the elongated top having a central section hook catch terminating in first end edges lateral to the top;

the elongated top between each first end edge of the central section and an adjacent second edge having a lateral depressed concave portion vertically lower than the adjacent central section first end edge;

each adjacent central section first end edge and depressed concave portion defining a vertical opening into which a free end of an operating rod hook can be operatively inserted; and a groove in the elongated top extending longitudinally outwardly from a second edge for slidably receiving and guiding an operating rod hook free end into a vertical opening to position it beneath the central section and above the two depressed concave portions.

2. A roller sponge mop sponge retainer comprising:

an elongated channel shaped sponge retainer adapted to receive and securely hold a roll mop sponge;

the retainer having an elongated top and two equally spaced apart side walls extending downwardly from the top;

the elongated top having a substantially uniform width and a longitudinal center line;

the elongated top having a central section hook 7 catch terminating in first end edges lateral to the top;

the elongated top between each first end edge of the central section and an adjacent second edge having a lateral depressed concave portion vertically lower than the adjacent central section first end edge;

each adjacent central section first end edge and depressed concave portion defining a vertical opening into which a free end of an operating rod hook can be operatively inserted; and a groove in the elongated top extending longitudinally outwardly from each second edge for slidably receiving and guiding an operating rod hook free end into a vertical opening to position it beneath the central section and above the two depressed concave portions.

3. A sponge retainer according to claim 2 adapted for use with a hook having a loop located between the hook free end and a rod portion perpendicular to the hook free end; and when the hook free end is beneath the central section the hook loop abuts a retainer top second edge and prevents withdrawal of the hook free end from the retainer.

4. A sponge retainer according to claim 2 in which the groove is between the top longitudinal center line and a side wall.

5. A sponge retainer according to claim 4 in which the groove has a laterally curved bottom.

6. A sponge retainer according to claim 5 in which the groove is widest and deepest at the second edge and becomes narrower and shallower with increase in length until it terminates by merging smoothly into the retainer top.

7. A sponge retainer according to claim 4 in which the groove is slightly slanted towards the longitudinal center line as it approaches the central portion.

8. A sponge retainer according to claim 2 in which the two grooves are on opposite sides of the longitudinal center line.

9. A sponge retainer according to claim 2 in which the retainer is a sheet metal stamping.

10. A sponge retainer according to claim 2 in which each end edge of the central section has a raised area on each side of the longitudinal center line of the retainer to facilitate inserting the free end of the hook, at an angle to the said center line beneath the central section, until the hook free end is above the depressed concave portion on the other side of the central section and the hook is then pivoted into alignment with the longitudinal center line of the retainer thereby preventing the hook from being displaced longitudinally from beneath the central section.

11. A sponge retainer according to claim 2 in which the central section has a longitudinal ridge beneath which the hook can nest.

* * * * *

UNITED STATES PATENT AND TRADEMARK OFFICE

CERTIFICATE OF CORRECTION

PATENT NO. : 4,862,550

DATED : September 5, 1989

INVENTOR(S) : DOUGLAS R. BATCHELOR

It is certified that error appears in the above-identified patent and that said Letters Patent is hereby corrected as shown below:

Column 4, line 51, delete "7".

Signed and Sealed this

Thirty-first Day of July, 1990

*Attest:*

HARRY F. MANBECK, JR.

*Attesting Officer*

*Commissioner of Patents and Trademarks*